US005143512A

United States Patent [19]

Corsmeier et al.

[11] Patent Number: 5,143,512

[45] Date of Patent: Sep. 1, 1992

[54] TURBINE ROTOR DISK WITH INTEGRAL BLADE COOLING AIR SLOTS AND PUMPING VANES

[75] Inventors: Robert J. Corsmeier, Cincinnati; Robert L. Sponseller, West Chester; James R. Reigel; Harvey M. Maclin, both of Cincinnati, all of Ohio

[73] Assignee: General Electric Company, Cincinnati, Ohio

[21] Appl. No.: 661,930

[22] Filed: Feb. 28, 1991

[51] Int. Cl.[5] ..... F01D 5/14

[52] U.S. Cl. ..... 415/115; 416/96 R

[58] Field of Search ..... 415/115, 116; 416/90 R, 416/92, 93 R, 95, 96 R

[56] References Cited

U.S. PATENT DOCUMENTS 3,814,539 6/1974 Klompas ..... 416/95
4,522,562 6/1985 Glowacki et al. .
4,674,955 6/1987 Howe et al. ..... 416/95
4,759,688 7/1988 Wright et al. ..... 415/116
4,882,902 11/1989 Reigel et al. ..... 415/115
4,890,981 1/1990 Corsmeier et al. ..... 416/95

FOREIGN PATENT DOCUMENTS 0945858 5/1949 France ..... 415/116

*Primary Examiner*—Edward K. Look
*Assistant Examiner*—Christopher M. Verdier
*Attorney, Agent, or Firm*—Jerome C. Squillaro

[57] ABSTRACT

A rotor disk for a gas turbine engine includes a central load-bearing web portion and a centrifugal pump portion located externally of the load-bearing web portion for pumping cooling air into an array of turbine blades. The pump portion includes an enlarged material section formed homogeneously with the web portion and extends axially forwardly and radially inwardly from the rim of the disk.

13 Claims, 6 Drawing Sheets

TURBINE ROTOR DISK WITH INTEGRAL BLADE COOLING AIR SLOTS AND PUMPING VANES

BACKGROUND OF THE INVENTION

1. Field of the Invention

The present invention relates in general to turbine rotors and, in particular, to a turbine disk having a cooling air flowpath formed through an axially enlarged portion of the disk for radially pumping cooling air into a turbine blade.

2. Description of Prior Developments

Modern gas turbine engines use a portion of the compressor air to cool the turbine rotor blades and other engine components heated by the hot flowing exhaust gases. The turbine compressor must not only pump and pressurize the air that is supplied to the combustor, but the compressor must also pump the air needed for cooling the heated turbine components. There is a substantial amount of compressor energy invested in providing the required flow of turbine cooling air. Part of this energy is recovered when the cooling air eventually enters the turbine flowpath through small cooling holes formed through the turbine blades.

An example of a conventional turbine engine cooling air flow circuit is shown in FIG. 1. Compressor discharge air 10 passes through diffuser vanes 12 and into and around combustor 14. A portion of discharge air 10 is used to cool the stator nozzles 16, the blade shrouds 18 and the rotor blades 20.

The rotor blade cooling air 10(*a*) flows past combustor 14 and passes through holes 22 provided in an inducer vane support 24. The cooling air 10(*a*) then flows over inducer vanes 26 which accelerate the cooling air to rotor speed and turn the cooling air in the direction that the rotor is turning. The cooling air is then channeled to the radially outer portion of turbine rotor disk 33 through holes 44 formed through a forward rotating seal 36.

The cooling air 10(*a*) then flows through holes or slots 28 in a blade retainer flange 30 before entering the dovetail slots 32 which are located at the radially outer end of turbine disk 33. Cooling air 10(*a*) then flows into the rotor blades 20 via radially-extending internal cooling passages 29 formed through each rotor blade. The cooling air then exits from the rotor blade cooling passages 29 into the gas stream 34 in a known fashion. A single labyrinth seal 80 is positioned axially forwardly and radially inwardly of the forward rotating seal 36 for preventing most of the compressor discharge leakage air 11 from reaching the forward rotating seal 36.

As better seen in FIG. 2, the forward rotating seal 36 is equipped with a large diameter toothed labyrinth seal 38 which discourages the leakage of cooling air 10(*a*) into the gas stream 34. A two tooth labyrinth seal 40 that is attached to the forward seal 36 discourages compressor discharge leakage air 11 from leaking into the inducer air cavity 42. Because the labyrinth seals 38 and 40 are positioned radially outwardly at a relatively large distance from their center of rotation, they tend to move radially during engine operation and thus tend to leak a large amount of valuable cooling air 10(*a*) into the flowpath of gas stream 34. This leakage can be so significant that it reduces engine performance and increases fuel consumption.

Increased engine performance could be achieved if the cooling air 10(*a*) could be pumped from the holes 44 in the forward rotating seal 36 directly to the disk dovetail slots 32. Although such pumping could be accomplished by attaching fins or tubes on forward rotating seal 36 to circuit the cooling air 10(*a*) from the holes 44 to the dovetail slots 32, it would be difficult or impossible for the forward rotating seal to carry the additional load created by the additional tubes or fins, particularly at such a large radius. This approach is therefore considered impractical.

A large reduction in labyrinth seal leakage could, however, be achieved by reducing the diameters of these seals and thereby improve engine performance. Thus, a more direct and efficient way of increasing engine performance is to reduce the diameters of the labyrinth seals 38 and 40. Unfortunately, as seen in FIG. 3, when the labyrinth seal diameters are reduced, the air shield arm 50 correspondingly increases in length.

This increase in the length of air shield arm 50 is so great that the forward rotating seal 36 can no longer withstand the resulting increased centrifugal forces generated at the increased air shield arm diameters. In addition, the cooling air 10(*a*) must be pumped a considerable distance radially outwardly from the holes 44 in the rotating seal 36 to enter the dovetail slot 32 in the turbine disk 33.

If the air shield arm 50 cannot withstand the increased centrifugal forces of its own increased length, it certainly cannot withstand these forces plus the added centrifugal forces which would develop if air tubes or fins were added to it. Accordingly, a need exists for a forward rotating seal and rotor disk assembly which reduces the diameters of the labyrinth seals without increasing the diameter of the air shield arm 50 and which efficiently pumps the cooling air to the turbine disk dovetail slots 32.

An additional problem encountered with conventional forward rotating seal designs is associated with the presence of bolt holes 46 such as required in the design of FIG. 3. These holes are highly stressed due to the radial loads placed on them. The forward seal disk hub 52 is required to carry not only the labyrinth seals, but also some joint loads from disk flange 54 and from the rotor shaft flange 56.

The bolt holes 46 are thus located between two pull forces. The seal hub 52 is pulling radially inwardly while the radially outer portion of the rotating forward seal is pulling radially outwardly. The highly stressed bolt holes 46 can reduce the useful life of the forward seal. It would therefore be desirable to eliminate the bolt holes in the forward seal.

A similar stress problem is associated with the bolt holes 48 that are located between the rotor disk dovetail slots 32 in the rim of the turbine disk 33. These holes plus the bolt holes in the blade retainers 58 and 60 are stress risers which reduce the life of the blade disk and blade retainers. Thus, a further need exists for a forward seal and rotor disk assembly wherein the effect of any bolt holes is minimized or the bolt holes are eliminated.

SUMMARY OF THE INVENTION

The present invention has been developed to fulfill the needs noted above and therefore has as an object the provision of a turbine rotor disk provided with a plurality of radially extending channels or slots for efficiently pumping cooling air from, for example, an annular array of static inducer vanes to a position radially outwardly to enter a plurality of dovetail slots formed in the outer rim of the turbine rotor disk.

Another object of the invention is to provide a forward rotating seal which sealingly co-acts with a turbine rotor disk so as to efficiently direct cooling air through the seal and virtually directly into a plurality of cooling air channels or slots formed in an axially enlarged unloaded bearing portion of the turbine rotor disk.

Another object of the invention is to provide a forward rotating seal with one or more annular labyrinth-type seal members located at relatively small diameters from their common center of rotation so as to improve their sealing performance.

Still another object of the invention is to eliminate the necessity of a large diameter air shield arm extending radially from a rotating forward seal.

Yet another object is to provide a forward seal for a gas turbine engine which not only avoids the use of fins and/or tubes between the forward seal and the turbine rotor disk but which also eliminates the need for mounting holes such as used to bolt prior forward seals to the rotor shaft.

Another object is to avoid the formation of cooling air channels or slots in the load carrying portion of the web of the rotor disk.

Briefly, the present invention includes a turbine rotor disk having an axially thickened portion which extends radially inwardly beneath the rim of the rotor disk and adjacent the web of the rotor disk. This axially thickened web portion is formed with a plurality of arcuate or straight cooling channels or slots which communicate with the axially extending dovetail slots formed in the rim of the rotor disk. Vanes are provided between the cooling channels to form a centrifugal pump for pumping cooling air into the dovetail slots. The dovetail slots communicate with cooling channels formed through the turbine blades for cooling the turbine blades in a known manner.

By providing the cooling channels in an axially thickened material section which forms a substantially load-free portion of the rotor disk, the central load carrying portion of the rotor disk is maintained intact, i.e., with a solid unbroken web section, thereby preserving the strength and useful life of the rotor disk. The radially inner and outer end portions of the axially thickened material section of the rotor disk may be formed with sealing surfaces for maintaining the cooling air within the cooling channels formed in the rotor disk.

The radially inner sealing surface of the axially thickened material section of the rotor disk may sealingly co-act with a short air shield arm projecting from the outer radial end of the forward rotor seal. The air shield arm may be maintained with a short radial length due to the axially thickened material section extending radially inwardly from the rim of the rotor disk to rotate against and form a seal with the air shield arm.

Not only does the axially thickened material section allow for a radially short air shield arm, but it also allows for the radial down-sizing of the labyrinth seals formed on the forward rotor seal. That is, the diameters of these labyrinth seals may be decreased with respect to prior designs because the cooling channels which extend radially inwardly from the rim of the rotor disk break out from the axially thickened material section at a relatively small radial distance from the center of the rotor disk.

Thus, the cooling channels extend radially inwardly to meet a radially short forward rotating seal rather than having the forward rotating seal extend radially outwardly to meet and seal against the rim portion of the rotor disk. This not only increases the effectiveness and efficiency of the forward seal but also results in a lower weight seal which experiences reduced centrifugal forces.

An additional benefit realized by the use of a radially short or compact forward seal is the ability to position the radially inner hub portion of the forward seal at a larger diameter than possible with prior designs. This allows the entire forward seal to be located on the exterior of the rotor shaft and to be radially supported by a radially inner labyrinth seal which is adapted to prevent compressor discharge leakage air from reaching the forward rotating seal. The forward rotating seal may then be formed without bolt holes as it is cantilevered from the radially inner labyrinth seal.

The aforementioned objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing, like reference characters designate like parts.

DETAILED DESCRIPTION OF THE PREFERRED EMBODIMENTS

Figure 5:
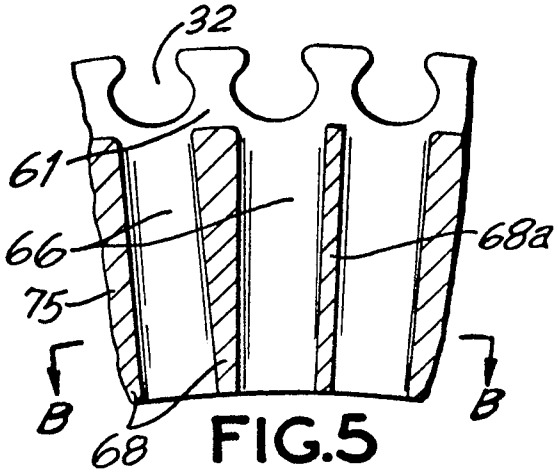
FIG. 5 is a fragmental radial sectional view taken through arc A—A of FIG. 4.
Figure 6:
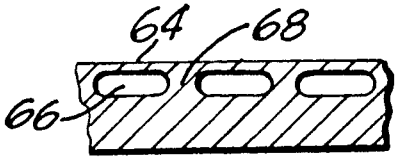
FIG. 6 is a fragmental sectional view taken through arc B—B of FIG. 5.

The present invention will now be described in conjunction with the drawings, beginning with FIGS. 4, 5 and 6 which show a forward rotating seal 36 rotatably secured to rotor shaft 39 via labyrinth seal 80. Labyrinth seal 80 prevents the majority of compressor discharge leakage air 11 from reaching the forward seal 36. Flange or arm 53, which projects rearwardly from labyrinth seal 80 provides a cantilevered support for the forward seal 36. Because of the co-action between the forward seal 36 and rotor disk 33 as discussed in detail below, the diameter of each of the toothed labyrinth seals 38,40 has been reduced by over five inches as compared to the design of FIG. 1. Since the forward rotating seal 36 is now smaller in diameter, centrifugal forces are significantly reduced so that more labyrinth teeth can be added to each labyrinth seal 38,40 without exceeding workable stress and weight limits. A stationary seal tooth 63 can be added to labyrinth seal 38 to further improve sealing performance. The forward rotating seal 36 of FIG. 4 has been found to reduce seal leakage by 60% compared to the design of FIG. 1.

Figure 1:
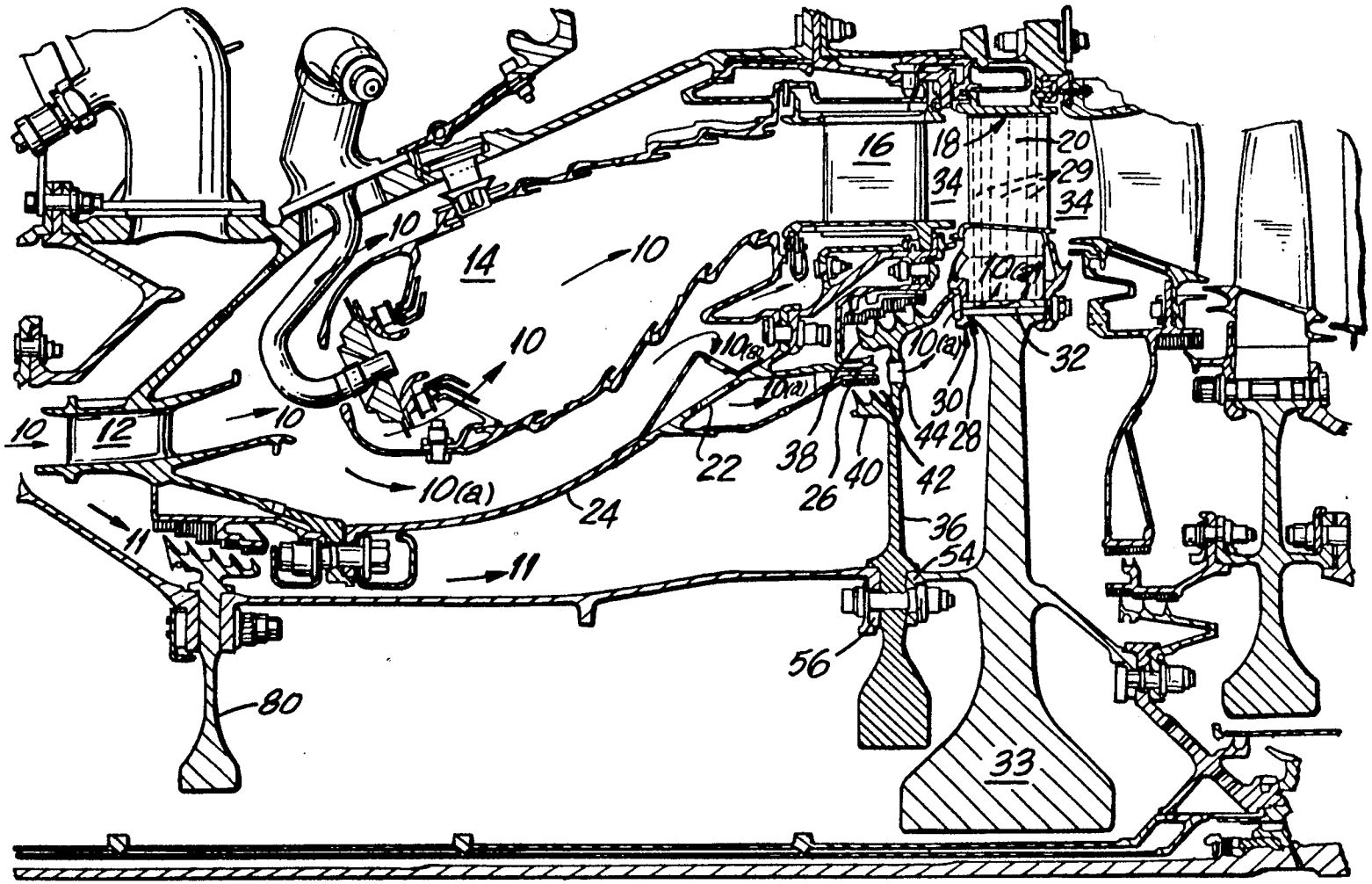
FIG. 1 (PRIOR ART)
FIG. 1 is an axial sectional view taken through a portion of a gas turbine engine having a forward seal and rotor disk designed according to the prior art.
Figure 2:
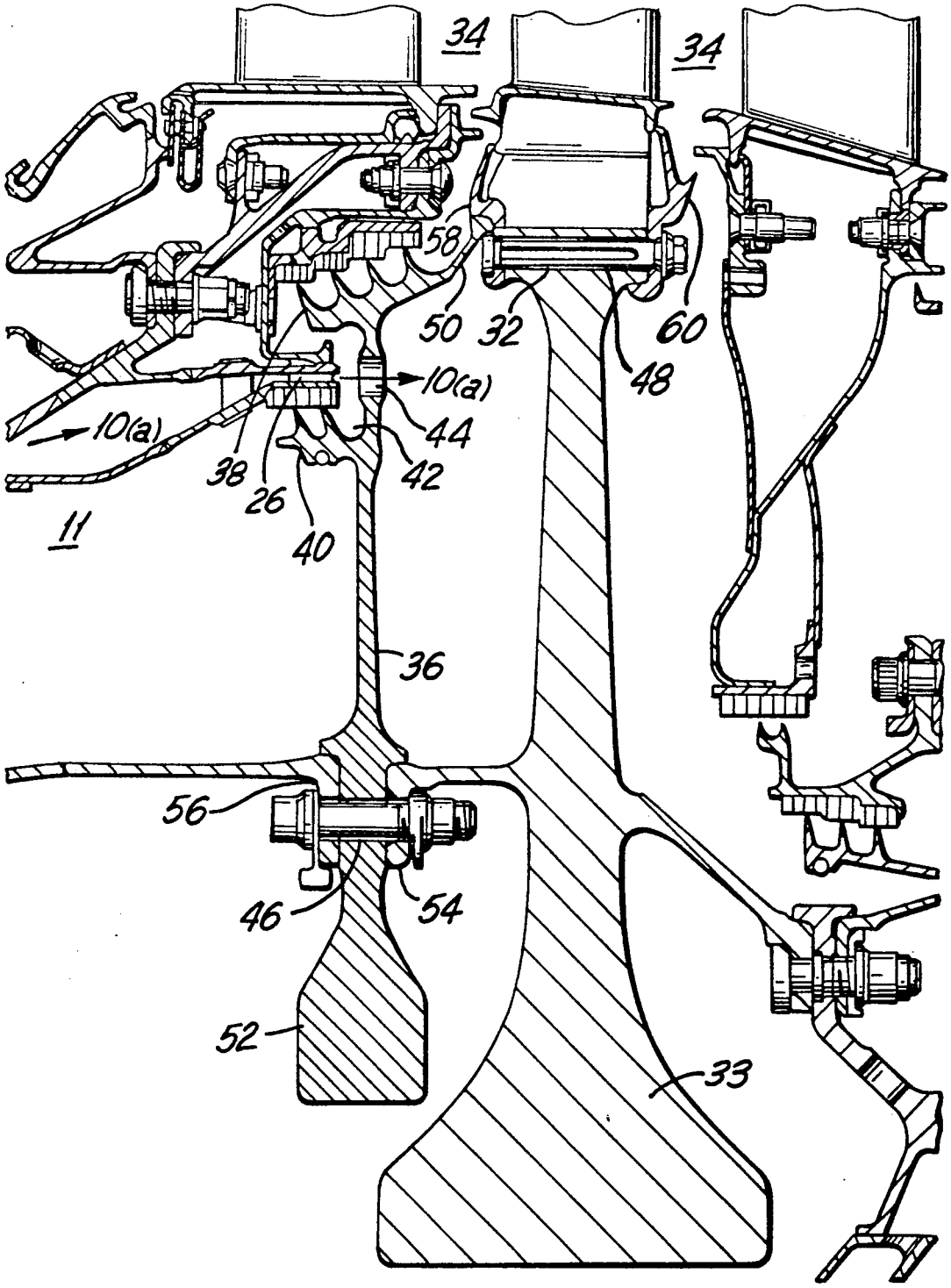
FIG. 2 (PRIOR ART)
FIG. 2 is an enlarged view of the forward seal and rotor disk of FIG. 1.
Figure 3:
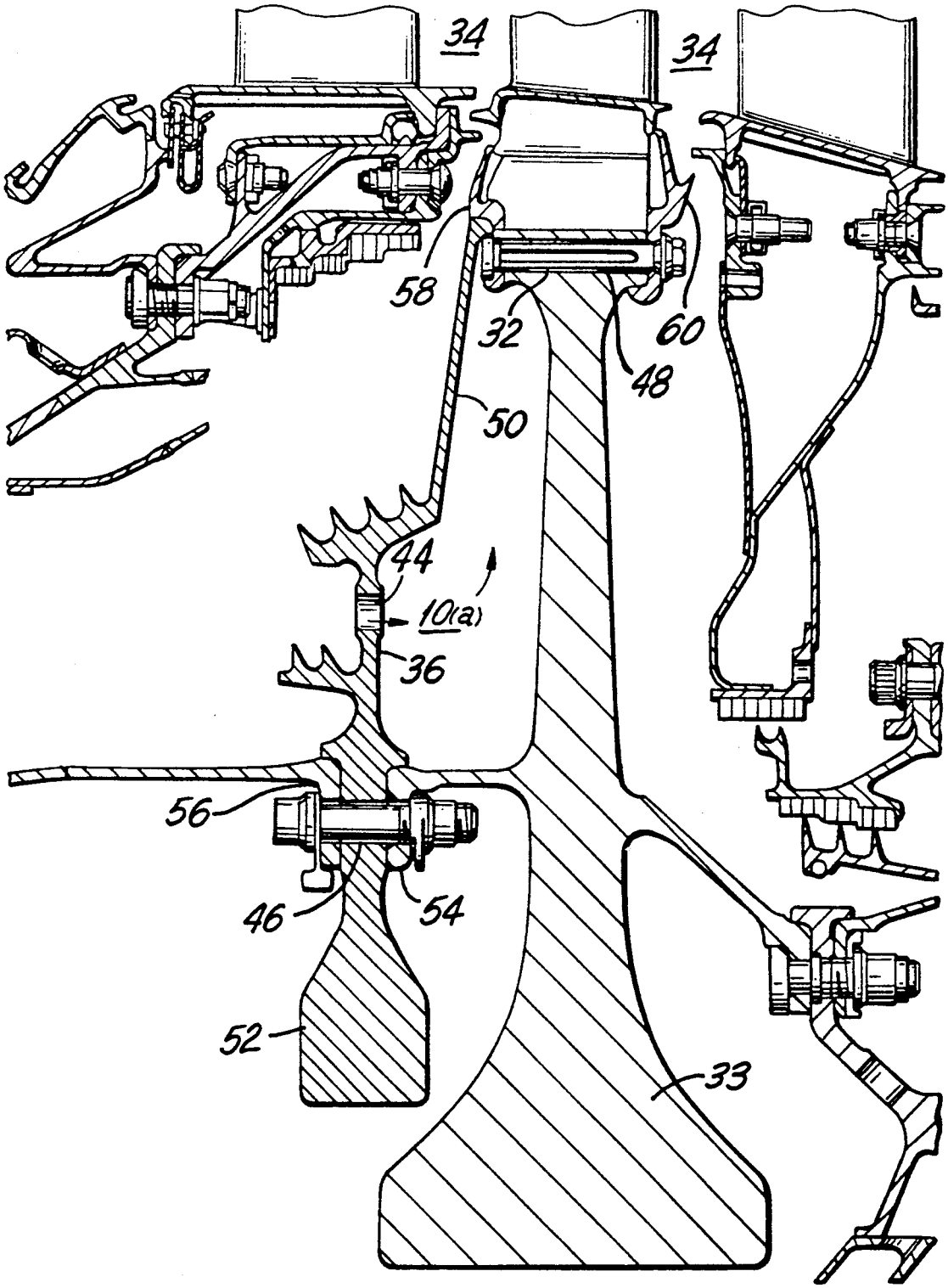
FIG.3 (PRIOR ART)
FIG. 3 is an alternate embodiment of the forward seal and rotor disk of FIG. 2 wherein the forward seal is formed with a radially elongated air shield arm.
Figure 4:
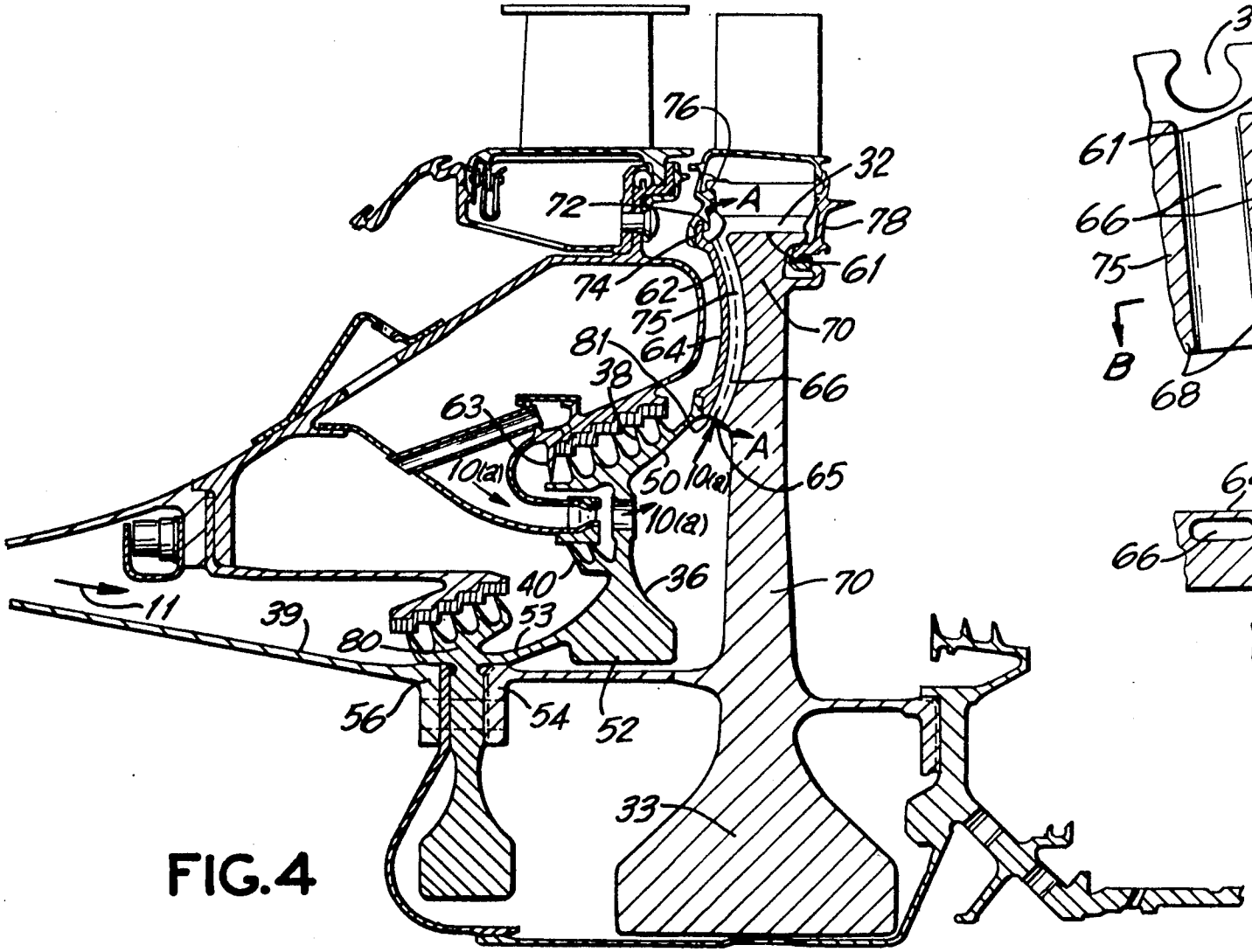
FIG. 4 is an axial sectional view taken through a portion of a gas turbine engine having a forward seal and rotor disk designed according to the present invention.

Another advantage gained by reducing the diameters of labyrinth seals 38 and 40 as shown in FIG. 4 is the elimination of a radially elongated air shield arm 50 such as shown in FIG. 3. Because labyrinth seal 38 is located proximate to the entry port 65 of each cooling air channel defined by each slot 66, air shield arm 50 may be maintained at a relatively short radial length. Moreover, working stress in air shield arm 50 is actually less than that experienced in prior designs such as shown in FIG. 1 because the air shield arm 50 of FIG. 4 rotates at a smaller radius and therefore experiences less centrifugal force.

A major feature of the present invention, and a key to lowering the diameters of labyrinth seals 38 and 40, is the design of air pump 62 which pumps the cooling air 10(*a*) radially outwardly into blade retaining dovetail slots 32 formed in the rim 61 of rotor disk 33. Pump 62 is integrally and homogeneously incorporated into disk 33 within an axially enlarged material section or boss 75 which extends and projects axially forwardly from the front surface of turbine rotor disk 33. Boss 75 extends radially inwardly from rim 61 to define an end wall 81 projecting from an intermediate portion of web portion 70.

The pump includes an outer wall 64, curved slots 66, and circumferentially-spaced, radially inwardly tapered ribs 68 or straight ribs 68*a*. The slots 66 do not run through the main load carrying web portion 70 of the turbine disk 33 as in prior designs. Rather, slots 66 extend radially over the exterior of web portion 70 to meet dovetail slots 32 at the axial front portion of rim 61 outside of the load bearing region of the rim. Slots 66 terminate at end wall 81 through which entry port 65 admits cooling air 10(*a*) into slots 66. The radially inner portion of outer wall 64 includes a sealing surface which engages and sealingly co-acts with air shield arm 50 to efficiently channel cooling air 10(*a*) into the flowpaths defined by slots 66 and vanes or ribs 68.

Turbine disks that have slots running through their web portions are, by necessity, heavier than the curved slot design of the present invention. This is because such slotted webs must include additional material around their slotted regions in order to provide the required strength to withstand the centrifugal forces generated during engine operation. The weight of rotor disk 33 in FIG. 4 need not be increased to such a degree since pump 62 is located in a virtually unloaded portion of the rotor disk.

It can be further seen in FIG. 4 that rotor disk 33 is formed with a flange 54 for connecting the rotor disk to rotor shaft 39. Both the hub 52 of forward seal 36 and the entire pump 62 are located radially outwardly of flange 54. Moreover, virtually the entire forward seal 36 is located radially inwardly of pump 32 at a relatively small distance from the center of rotation of forward seal 36.

Figure 8:
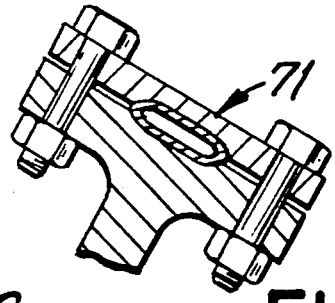
FIG. 8 is a fragmental sectional view taken through line C—C of FIG. 7.
Figure 7:
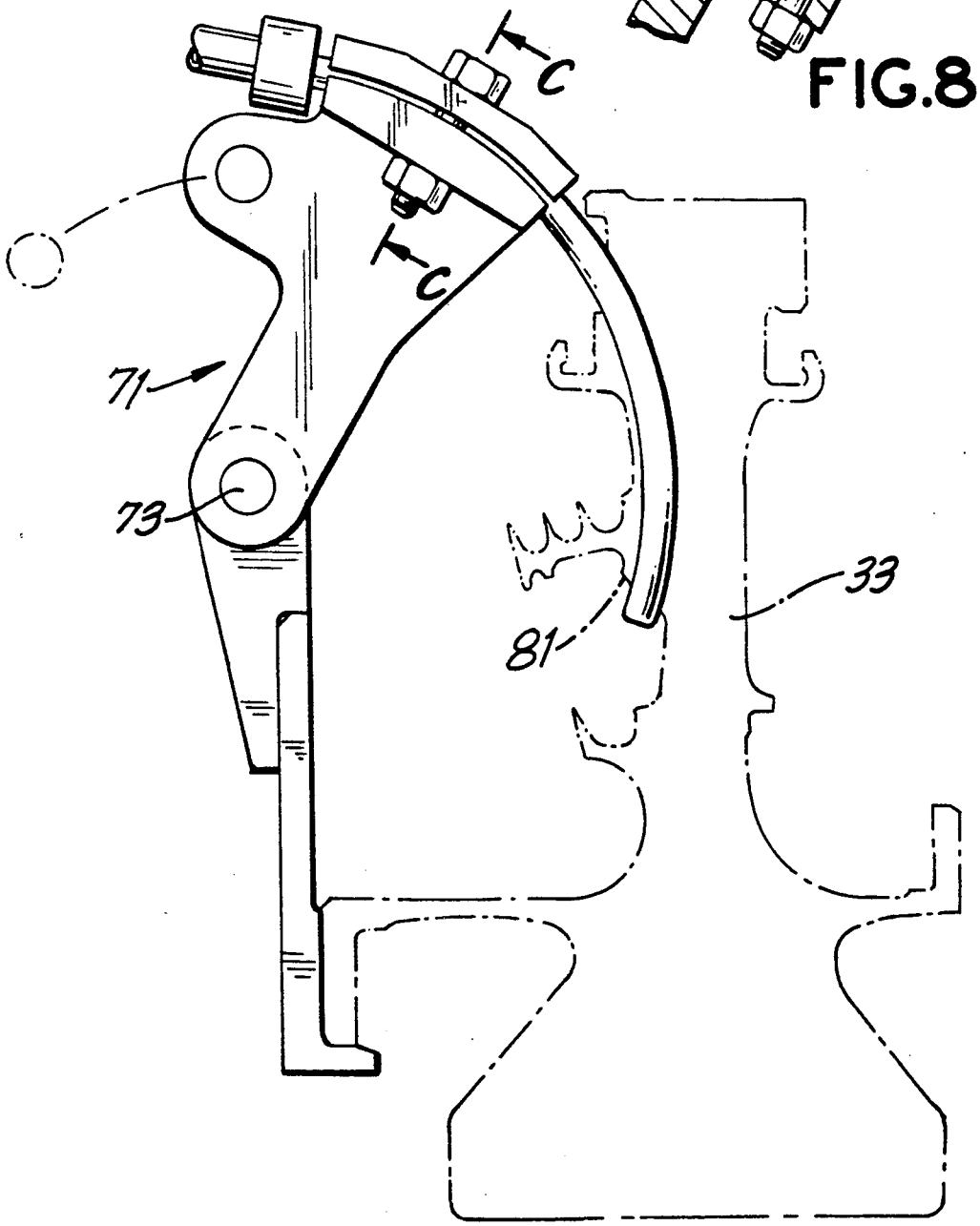
FIG. 7 is a schematic view of an ECM tool adapted for forming the cooling slots in the rotor disk shown in FIG. 4.
Figure 10:
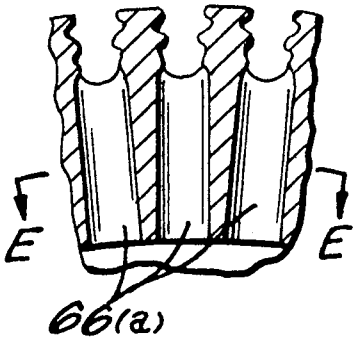
FIG. 10 is a radial sectional view taken along line D—D of FIG. 9.
Figure 11:
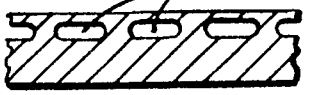
FIG. 11 is a sectional view taken through line E—E of FIG. 10.
Figure 9:
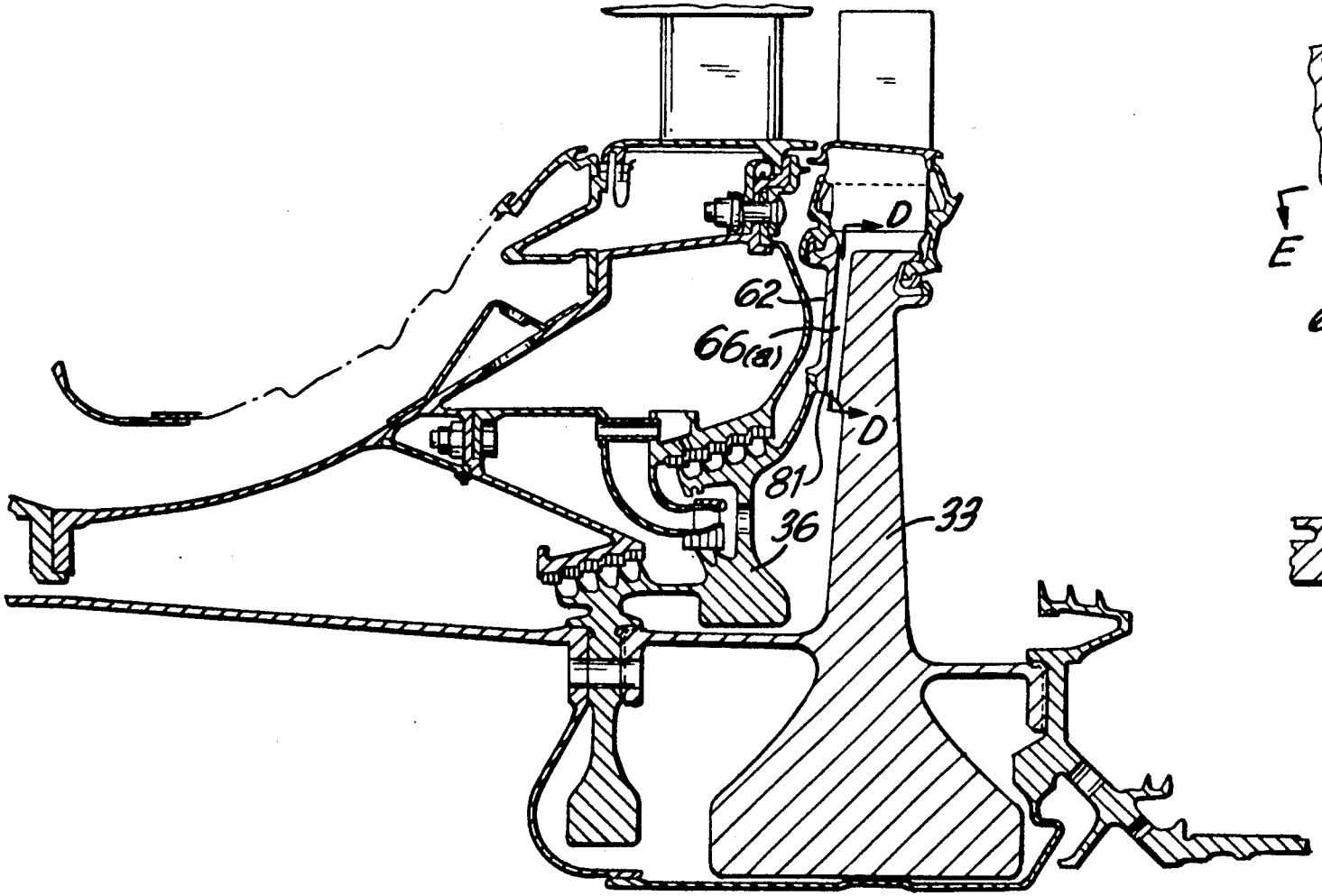
FIG. 9 is an alternate embodiment of the invention of FIG. 4 showing the use of straight cooling channels formed in the rotor disk.

As seen in FIGS. 7 and 8, the curved cooling air slots 66 of FIG. 4 may be defined by true radii formed by swinging a ECM tool 71 with an arced electrode from a common axis 73. As seen in FIGS. 9, 10 and 11, for some disks a straight slot 66(*a*) formed completely externally of the turbine disk web 70 on the forward side of the turbine disk web may be more desirable than a curved slot.

Referring again to FIG. 4, a radially compact boltless blade retainer and seal 72 is held axially in place by a lip 74 that is integral with the outer wall 64 of the pump 62. This blade retainer is positioned radially by a rabbet 76 on the turbine disk dovetail post and forms a seal against the radially outer end portion of outer wall 64 adjacent rim 61. A larger boltless blade retainer and seal 78 of the type disclosed in U.S. Pat. No. 4,304,523 is used on the aft side of the disk rim. By using these boltless blade retainers, the high stress bolt holes in the blade retainers and disk rim are eliminated.

The high stress bolt holes 46 in the forward seal 36 shown in FIG. 3 have been eliminated by increasing the inner diameter of the hub 52 of the forward seal as seen in FIG. 4. Increasing the diameter of the hub 52 is made possible because the outside diameter of forward seal 36 is significantly decreased. In one example, the outside diameter of forward seal 36 can be reduced by 5 inches compared to prior designs. This greatly reduces the weight of the forward seal which in turn reduces the load that the hub 52 must carry.

It can now be readily appreciated that the present invention provides a lightweight and efficient assembly for transferring the rotor blade cooling air from an inner diameter location radially outwardly to the blade dovetail.

This design greatly reduces the large diameter of the forward rotating seal 36 which, in turn, reduces associated stress, reduces seal leakage which, in turn, improves SFC and reduces weight. Moreover, there are no bolt holes or air holes through the disk rim or disk web and the high stress bolt holes through the forward seal have been eliminated. Most importantly, cooling air slots in pump 62 do not run through the load carrying portions of the disk web.

There has been disclosed heretofore the best embodiment of the invention presently contemplated. However, it is to be understood that various changes and modifications may be made thereto without departing from the spirit of the invention.

What is claimed is:

1. A rotor disk for a gas turbine engine, comprising:

a hub portion;

a web portion extending radially outwardly from said hub portion;

a rim portion disposed on a radially outer end portion of said web portion;

an enlarged material section defining a boss projecting axially from said web portion and extending radially inwardly from said rim portion to define an end wall projecting from an intermediate portion of said web portion;

an internal slot formed through said enlarged material section and extending radially from said rim portion to said end wall, said slot forming an entry port in said end wall for admitting cooling air into said slot for pumping said cooling air radially outwardly adjacent said web portion and into said rim portion; and a sealing surface formed on said boss adjacent said end wall.

2. The disk of claim 1, wherein said slot defines an arcuate flowpath.

3. The disk of claim 1, wherein said slot defines a linear flowpath.

4. The disk of claim 1, wherein said rim portion is formed with at least one blade retaining slot extending axially therethrough and wherein said internal slot meets with said retaining slot at an axial front portion of said rim portion.

5. The disk of claim 1, further comprising a flange for mounting said disk to a rotor shaft and wherein said enlarged material section is disposed radially outwardly of said flange.

6. The disk of claim 1, wherein said enlarged material section is formed homogeneously with said web portion.

7. The disk of claim 1, wherein said internal slot is disposed completely externally of said web portion.

8. A forward seal and rotor disk assembly, comprising:

a rotor disk comprising a hub portion, a web portion, a rim portion, and a material section extending axially forwardly from said web portion and having a plurality of slots formed there-through;

a forward seal comprising a hub portion, a first labyrinth seal, and an air shield arm projecting from said first labyrinth seal and sealingly engaging said material section of said rotor disk; and a second labyrinth seal for sealing compressor discharge leakage air, said second labyrinth seal comprising a support arm for supporting said forward seal.

9. The assembly of claim 8, wherein said forward seal is cantilevered from said second labyrinth seal.

10. The assembly of claim 8, wherein said rotor disk further comprises a flange for mounting said rotor disk to a rotor shaft and wherein said hub portion of said forward seal is disposed radially outwardly of said flange.

11. The assembly of claim 8, wherein said rotor disk further comprises a flange for mounting said rotor disk to a rotor shaft and wherein said plurality of slots is disposed radially outwardly of said flange.

12. A forward seal and rotor disk assembly, comprising:

a rotor disk comprising a hub portion, a web portion, a rim portion, and a boss projection axially forwardly from an outer radial portion of said web portion, said boss having a radial cooling slot formed therein for channeling cooling air radially outwardly along said web portion to said rim portion;

a forward seal sealingly engaging said boss; and an inner seal for sealing compressor discharge air, said inner seal comprising a support interconnecting said inner seal and said forward seal and supporting said forward seal on said inner seal.

13. The assembly of claim 12, wherein said forward seal and said inner seal each comprises a labyrinth seal.

* * * * *